US005927614A

United States Patent [19]

Touvelle et al.

[11] Patent Number: 5,927,614

[45] Date of Patent: Jul. 27, 1999

[54] MODULAR CONTROL VALVE FOR A FUEL INJECTOR HAVING MAGNETIC ISOLATION FEATURES

[76] Inventors: Matthew S. Touvelle, 5620 N. Arrow Dr., Peoria, Ill. 61614; Dana R. Coldren, 40 Lake View Dr., Fairbury, Ill. 61739; Steven B. Coleman, 500 W. Richwoods Blvd., Peoria, Ill. 61604

[21] Appl. No.: 08/916,856

[22] Filed: Aug. 22, 1997

[51] Int. Cl.[6] ..... F02M 47/02

[52] U.S. Cl. ..... 239/585.1; 239/88; 239/90; 239/91; 239/585.2; 251/129.02; 251/129.07; 251/129.16

[58] Field of Search ..... 239/88, 89, 90, 239/91, 585.1, 585.2, 585.3; 335/250, 260, 278; 251/129.02, 129.07, 129.15, 129.16; 336/96

[56] References Cited

U.S. PATENT DOCUMENTS

| | | | |
|---|---|---|---|
| 3,909,758 | 9/1975 | Hans et al. | 335/250 X |
| 4,173,822 | 11/1979 | Futterer et al. | 29/596 |
| 4,390,130 | 6/1983 | Linssen et al. | 239/585 |
| 4,405,912 | 9/1983 | Palma et al. | 335/260 |
| 4,475,690 | 10/1984 | Hascher-Reichl | 239/585 |
| 4,646,976 | 3/1987 | Rembold et al. | 239/585.3 |
| 4,653,455 | 3/1987 | Eblen et al. | 239/88 X |
| 4,690,373 | 9/1987 | Linder et al. | 251/129.16 X |
| 4,693,273 | 9/1987 | Reynolds et al. | 137/596.13 |
| 4,795,098 | 1/1989 | Kirchner et al. | 239/585 |
| 4,830,286 | 5/1989 | Asslaender et al. | 239/585.3 |
| 4,844,036 | 7/1989 | Bassler et al. | 123/470 |
| 4,857,003 | 8/1989 | Hafner et al. | 439/130 |
| 4,950,171 | 8/1990 | Muzslay | 439/76 |
| 5,030,116 | 7/1991 | Sakai et al. | 439/130 |
| 5,076,499 | 12/1991 | Cranford | 239/585.2 |
| 5,131,857 | 7/1992 | Gmelin et al. | 439/130 |
| 5,138,292 | 8/1992 | Forster | 336/96 X |
| 5,155,461 | 10/1992 | Teerman et al. | 335/260 |
| 5,185,919 | 2/1993 | Hickey | 29/602.1 |
| 5,211,341 | 5/1993 | Wieczorek | 239/585.3 |
| 5,220,301 | 6/1993 | Haas et al. | 335/278 |
| 5,238,415 | 8/1993 | Bittner et al. | 439/130 |
| 5,407,131 | 4/1995 | Maley et al. | 239/90 |
| 5,465,910 | 11/1995 | Hall et al. | 239/585.4 |
| 5,533,249 | 7/1996 | Wakeman | 251/129.15 X |
| 5,546,063 | 8/1996 | Hoffman | 335/229 |
| 5,605,289 | 2/1997 | Maley et al. | 251/129.02 X |
| 5,651,501 | 7/1997 | Maley et al. | 239/88 |
| 5,700,139 | 12/1997 | Rodriguez-Amaya | 251/129.15 X |

*Primary Examiner*—Andres Kashnikow
*Assistant Examiner*—Robin O. Evans
*Attorney, Agent, or Firm*—Michael B. McNeil

[57] ABSTRACT

A control valve includes a terminal assembly that has a terminal electrically connected to one of a male electrical connector and female electrical connector. A solenoid assembly includes a metallic solenoid housing defining a solenoid cavity. A solenoid coil and the other of the male electrical connector and the female electrical connector are molded into a plastic solenoid carrier. The plastic solenoid carrier is attached to the metallic solenoid housing and preferably molded into the solenoid cavity. The solenoid assembly is attached to the terminal assembly, and said male electrical connector is mated to the female electrical connector. An armature is positioned between a portion of the terminal assembly and the solenoid coil. A valve member is attached to the armature.

20 Claims, 5 Drawing Sheets

MODULAR CONTROL VALVE FOR A FUEL INJECTOR HAVING MAGNETIC ISOLATION FEATURES

TECHNICAL FIELD

The present invention relates generally to control valves, and more particularly to modular control valves for fuel injectors having magnetic isolation features.

BACKGROUND ART

Examples of electronically controlled cartridge control valves for fuel injectors are shown in U.S. Pat. No. 5,494,219 to Maley et al., U.S. Pat. No. 5,407,131 to Maley et al., U.S. Pat. No. 4,869,462 to Logie et al., and U.S. Pat. No. 4,717,118 to Potter. In each of these examples, the injector includes a mechanically actuated fuel pumping plunger and an electronically actuated fuel pressure control valve assembly. The pressure control valve assembly includes a solenoid operated poppet valve member that controls fuel pressure in the injector in order to control fuel injection delivery and timing. Fuel pressure is controllably enabled to be developed within the injector by electrical actuation of the pressure control valve assembly. Fuel pressure is controllably prevented from developing within the injector by not electrically actuating the pressure control valve so that fuel can spill through a return passage while the plunger is undergoing a portion of its downward pumping stroke.

In such electronically controlled fuel injectors, the armature of the pressure control valve assembly moves the poppet valve member in one direction until it engages a valve seat, and holds the poppet valve in its closed position to enable fuel pressure to be developed in the injector, eventually resulting in fuel injection. At the end of the fuel injection cycle, the solenoid is de-energized, and a return spring moves the poppet valve member off the valve seat, returning the poppet valve member to its open position, which prevents the development of fuel pressure by spilling the fuel back to a fuel reservoir.

Engineers are often looking for ways to improve the performance and reliability of control valves. Performance can be improved by shortening the response time of the valve. A shortening of the response time can be accomplished both by improving the speed at which force develops within the solenoid and by increasing the magnitude of the force produced by the solenoid. However, space constraints and other factors known in the art often prevent the use of larger solenoids, and the use of exotic materials to hasten the build up of force in the solenoid is often prohibitively expensive. Reliability in a control valve can be improved by decreasing the number of electrical connections existing between an external terminal and the wire winding of the solenoid. By decreasing the number of connections, robustness of the valve can be improved. Furthermore, a reduction in electrical joints is often accompanied by a corresponding decrease in the number of parts required to assemble the control valve. Generally, an over all decrease in the part count for a particular control valve is desirable both from a manufacturing and cost view point. Finally, there is usually room to improve the manufacturability of a control valve by both decreasing the part count and simplifying the assemblage of the remaining components.

The present invention is directed to improving control valves.

DISCLOSURE OF THE INVENTION

A control valve includes a terminal assembly having a terminal electrically connected to one of a male electrical connector and a female electrical connector. A solenoid assembly includes a metallic solenoid housing defining a solenoid cavity, a solenoid coil and the other of the male electrical connector and the female electrical connector molded into a plastic solenoid carrier. The plastic solenoid carrier is attached to the metallic solenoid housing and positioned in the solenoid cavity. The solenoid assembly is attached to the terminal assembly and the male electrical connector is mated to the female electrical connector. An armature is positioned between a portion of the terminal assembly and the solenoid coil. A valve member is attached to the armature.

In another embodiment of the present invention, the terminal assembly includes a metallic terminal housing that defines a terminal cavity. A plastic terminal carrier is molded around a portion of a terminal and one of a male electrical connector and a female electrical connector. The plastic terminal carrier is positioned in the terminal cavity and attached to the metallic terminal housing. In addition, this embodiment includes features by which the solenoid is magnetically isolated from the metallic housings, improving the magnetic circuit and magnetic response time.

In still another embodiment of the present invention, a fuel injector includes an injector body defining a fuel inlet, a nozzle outlet and a cartridge opening, and further defines a spill passage and a return passage that open into the cartridge opening. A cartridge control valve is received in the cartridge opening and attached to the injector body. The cartridge control valve includes a terminal assembly attached to a solenoid assembly. The cartridge control valve defines a portion of an outlet passage that opens to the return passage, and also defines a portion of an inlet passage that opens to the spill passage. A valve member is positioned to reciprocate in the cartridge control valve between an open position in which the inlet passage is open to the outlet passage and a closed position in which the outlet passage is closed to the inlet passage. The terminal assembly includes a terminal electrically connected to one of a male electrical connector and a female electrical connector. The solenoid assembly includes a metallic solenoid housing defining a solenoid cavity. A solenoid coil and the other of the male electrical connector and the female electrical connector are molded into a plastic solenoid carrier. The plastic solenoid carrier is attached to the metallic solenoid housing and positioned in the solenoid cavity.

BEST MODE FOR CARRYING OUT THE INVENTION

Figure 1:
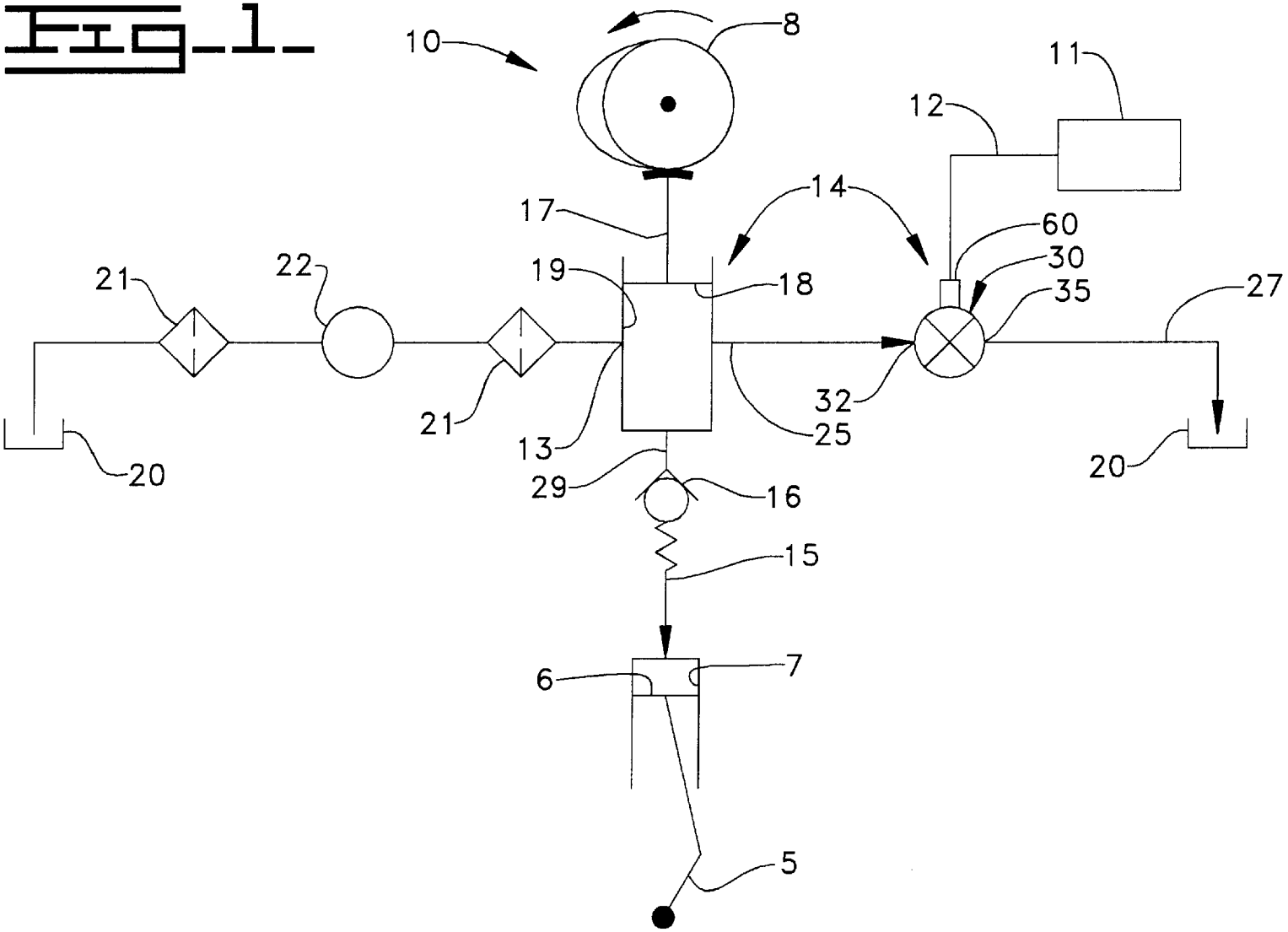
FIG. 1 is a schematic diagram illustrating a mechanically actuated electronically controlled fuel injection system.

In the drawings, the same reference numerals designate the same elements for features throughout all of the drawings.

Referring now to FIG. 1, there is illustrated an injector fuel system 10 adapted for a diesel-cycle direct-injection internal combustion engine having a number of engine pistons, only one of which is shown, i.e. piston 6. Each engine piston and corresponding engine cylinder would have a different fuel injector 14. Each engine piston 6 reciprocates in a separate cylinder 7 due to rotation of the engine crank shaft 5 in a conventional manner. Crank shaft 5 also rotates cam 8 which acts upon a tappet 17 of each injector 14 to mechanically actuate the injectors with each revolution of the engine.

Fuel injection system 10 includes a fuel source or tank 20. Fuel is drawn from fuel tank 20 by a relatively low pressure transfer pump 22, which carries the fuel through one or more fuel filters 21 to the fuel inlet 13 of each injector 14. With each revolution of cam 8, tappet 17 drives a pump piston 18 downward in pump chamber 19. Pump chamber 19 is connected to a spill passage 25 and a nozzle chamber 29 within injector 14. When fuel pressure within pumping chamber 19 is above a valve opening pressure, needle check valve 16 opens and fuel commences to spray into cylinder 7 through nozzle outlet 15. The fuel is prevented from reaching the valve opening pressure as long as spill passage 25 is open.

Spill passage 25 is connected to an inlet passage 32 of cartridge control valve 30. An outlet passage 35 from cartridge control valve 30 is connected to a return passage 27, which in turn is connected back to fuel tank 20 for recirculation. Fuel injection is controlled by opening and closing cartridge control valve 30 to open and close fluid communication between inlet passage 32 and outlet passage 35. In this case, inlet passage 32 passes completely through valve body portion 41 and has a straight centerline 39. Corners in a high pressure passage are undesirable because cracks can sometimes develop over time. The opening and closing of cartridge control valve 30 is controlled by a conventional electronic control module 11 that commands the energization or de-energization of a solenoid 60 via a communication line 12 in a conventional manner.

Figures 2, 4:
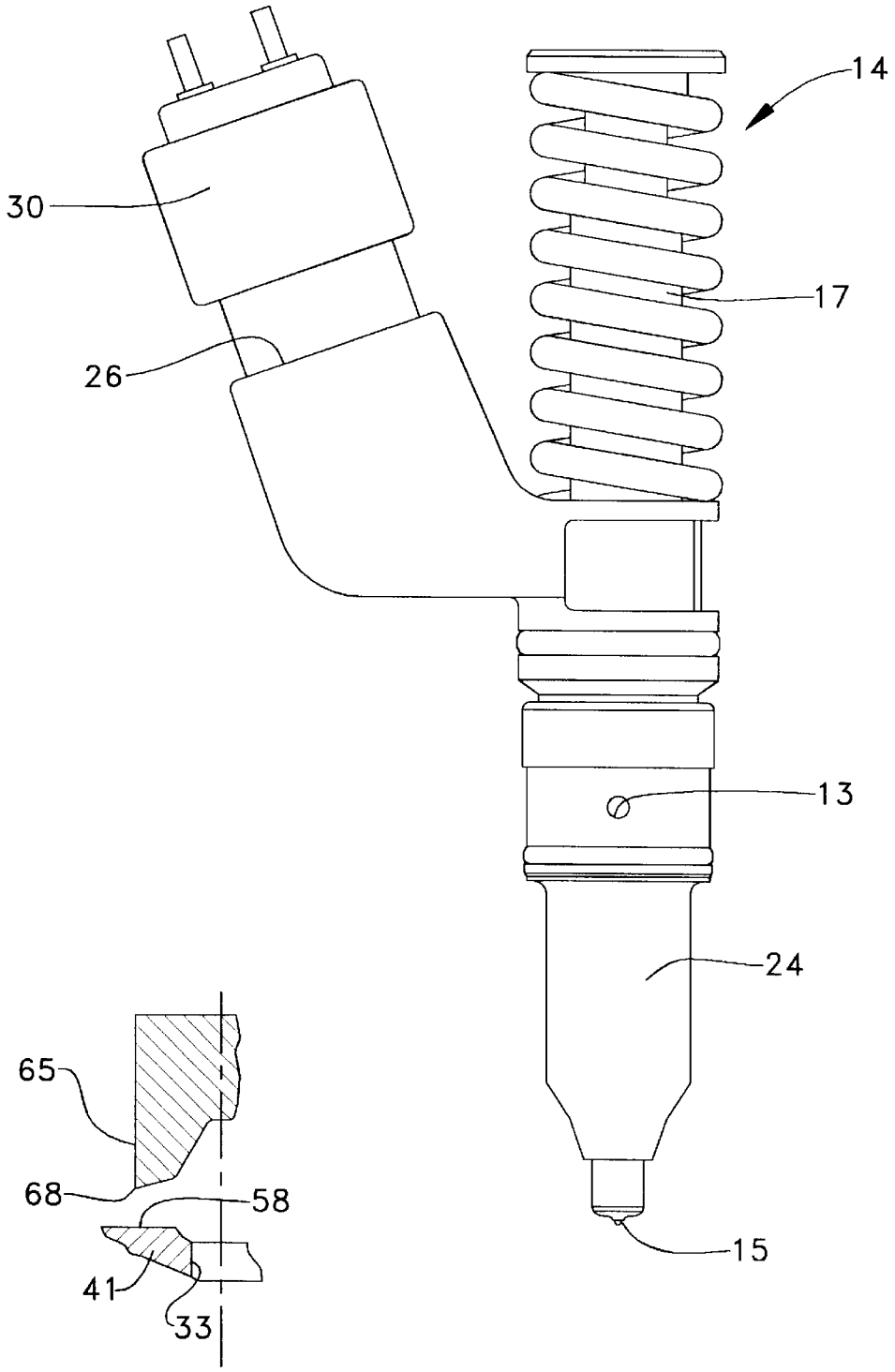
FIG. 2 is an elevational view of a fuel injector incorporating a cartridge control valve according to one embodiment of the present invention.
FIG. 4 is a fragmented sectional view illustrating a flat valve seat and a valve member with a knife edge valve surface in accordance with one aspect of the present invention.

Referring now to FIG. 2, an example injector 14 according to the present invention is illustrated. Fuel injector 14 includes an injector body 24, a fuel inlet 13, a nozzle outlet 15 and a cartridge opening 26 formed in injector body 24. A cartridge control valve 30 is received in cartridge opening 26 and attached to injector body 24.

Figure 3:
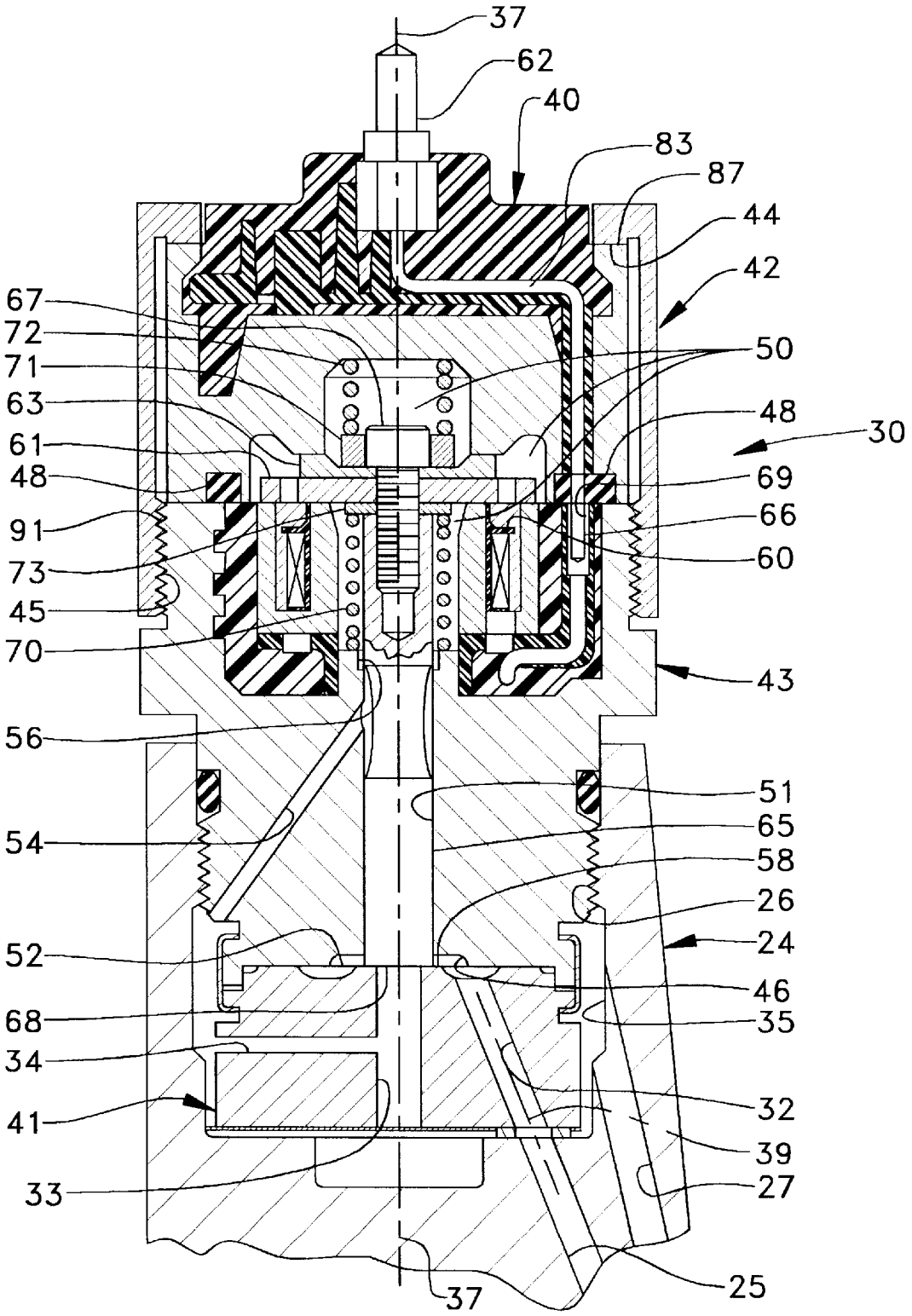
FIG. 3 is a sectioned side elevational view of a cartridge control valve according to the present invention.

Referring now to FIG. 3, the inner structure of cartridge control valve 30 is illustrated. Cartridge control valve 30 includes a body made up of a plurality of generally cylindrically shaped components 40, 41, 42 and 43 that are attached to one another along a centerline 37 in a manner well known in the art. In this case, hollow cap 42 is used to attach terminal assembly 40 to solenoid assembly 43. Fasteners, such as bolts, could be substituted in place of hollow cap 42. Solenoid assembly 43 is then attached to injector body 24 via external threads 91 and matched internal threads in cartridge opening 26. When cartridge control valve 30 is attached to injector body 24, its inlet passage 32 is connected to a spill passage 25, which is connected to the pump chamber within the injector as discussed earlier. Also, an annular outlet passage 35 is connected to a return passage 27. A poppet valve member 65 is mounted within control valve 30 and reciprocates between an open position in which annular outlet passage 35 is open to inlet passage 32 via a vertical outlet passage 33 and a plurality of horizontal outlet passages 34, only one of which is shown. Poppet valve member 65 can also be moved downward by solenoid 60 to a closed position in which inlet passage 32 is closed to annular outlet passage 35.

The various components of cartridge control valve 30 are preferably attached to one another in a way that seals against leakage of fuel out of cartridge control valve 30. When attached, terminal assembly 40 and solenoid assembly 43 define an inner cavity 50 which is wetted with fuel via metering passage 54 during operation of the valve. Poppet valve member 65 is attached to an armature 61 via a fastener 67 which is preferably made from a nonmagnetic material. Inner cavity 50 is wetted but is sealed against leakage to the outside of cartridge control valve 30 by a rubber perimeter sealing member 48. In this embodiment, a portion of metering passage 54 includes a diametrical clearance area 56 that is located between a portion of poppet valve member 65 and an enlarged diameter portion 56 of guide bore 51.

A return spring 70 normally biases poppet valve member 65 upward to its open position. A spacer 73, which is preferably made from a non-magnetic material is positioned between return spring 70 and the underside of armature 61. The upward force of return spring 70 is trimmed during manufacture of cartridge control valve 30 through the use of a relatively weak trimming spring 72 and a trimming spacer 71 in a conventional manner. Making spacer 73 and fastener 67 from a non-magnetic metallic alloy serves to aid in magnetically isolating armature 61 from ferromagnetic portions of terminal assembly 40 and solenoid assembly 43. An armature stop 63, which is preferably made from a non-magnetic material when spacer 73 and fastener 67 are magnetic, is positioned between fastener 67 and armature 61 and insures that there is always space between armature 61 and the ferromagnetic metal portions of terminal housing assembly 40. This acts to further magnetically isolate armature 61 from the ferromagnetic metals surrounding it. Armature stop 63 limits the upward movement of armature 61 and valve member 65 when it comes into contact with the underside of terminal assembly 40 (see stop surface 85 in FIG. 5).

Referring now also to FIG. 4, valve body portion 41 is machined to include a relatively flat annular seating surface 58 that defines a portion of a spill cavity 52, which is defined by the joinder of valve body portion 41 and solenoid assembly 43. One end of poppet valve member 65 is machined to include an annular knife edge valve surface 68 that closes spill cavity 52 to vertical outlet passage 33 when seated against flat seating surface 58. Thus, return spring 70 normally biases annular knife edge 68 away from flat seating surface 58 as shown in FIG. 4; however, when solenoid 60 is energized, poppet valve member 65 is pulled downward to seat annular knife edge 68 against flat seating surface 58 to close fluid communication between inlet passage 32 and outlet passages 33, 34 and 35. Poppet valve member 65 is preferably hydraulically balanced by having a first hydraulic surface area exposed to fluid pressure in inner cavity 50 that is about equal to a second hydraulic surface area that is exposed to fluid pressure in vertical outlet passage 33. Thus, except for fluid pressure gradients existing between inner cavity 50 and vertical outlet passage 33, the only forces acting on poppet valve member 65 should originate from solenoid 60, return spring 70 and trimming spring 71.

Although the high fuel pressures existing in inlet passage 32 and spill cavity 52 during an injection event will inevitably cause a small amount of fuel to leak along the outer surface of poppet valve member 65 along guide bore 51, inner cavity 50 is substantially isolated from inlet passage 32 when poppet valve member 65 is in its closed position. However, when poppet valve member 65 is in its open position, inner cavity 50 is in fluid communication with inlet passage 32 via spill cavity 52, vertical spill passage 33, horizontal spill passages 34, outlet passages 35 and most importantly metering passage 54. The use of a wetted inner cavity 50 permits the fuel within inner cavity 50 to damp the movement of poppet valve 65 so that it does not bounce back toward its closed position upon contacting its back stop at its open position. Metering passage 54 also serves to relieve any excess fluid pressure in inner cavity 50 so that poppet valve member 65 remains hydraulically balanced.

Figure 5:
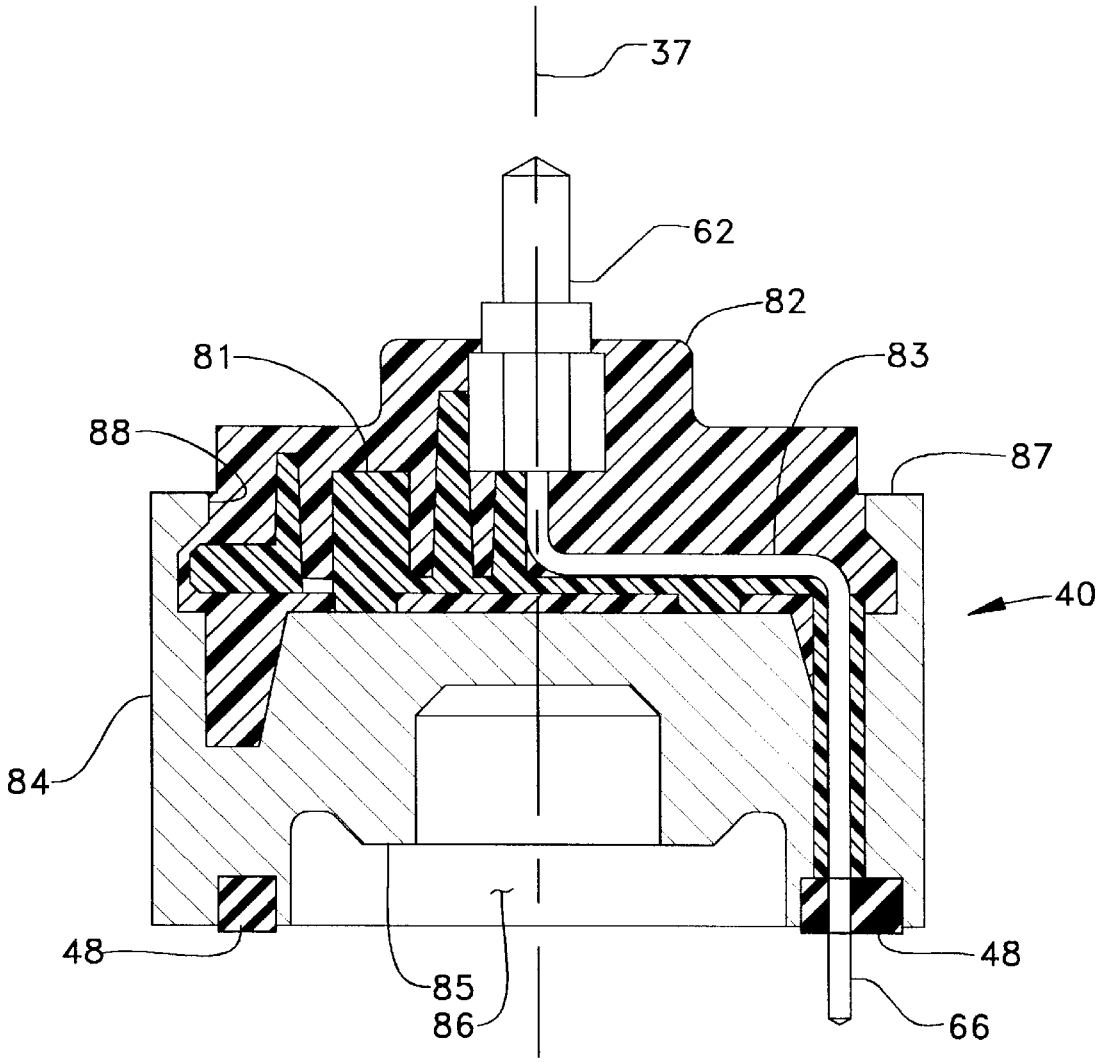
FIG. 5 is a sectioned side elevational view of a terminal assembly according to one aspect of the present invention.

Referring now in addition to FIG. 5, terminal assembly 40 behaves as a single rigid integral component when assembled as shown. Terminal assembly 40 includes a terminal housing 84 made from a suitable metallic alloy to include a lower cavity 86 and a terminal cavity 88. A portion of lower cavity 86 includes a stop surface 85 against which the armature stop 63 described earlier abuts when the valve member 65 is moved to its upward open position by return spring 70. The remaining portions of lower cavity 86 allow room for trimming spring 72, trim spacer 71, a portion of fastener 67, armature stop 63 and armature 61. A terminal 62 is connected to a male electrical connector 66 via a bent pin conductor 83 made from a suitable conductive material, such as mild steel. During manufacture, these electrical components are mounted on a terminal stud carrier 81, which is preferably made from a suitable non-electrically conducting plastic material. This assembly is then positioned in terminal cavity 88 and a plastic cover 82, preferably of nylon, is injection molded around these components to fix the same in the position shown in terminal cavity 88. Cover 82 could also be molded outside of cavity 88 and then attached with a threaded engagement or by suitable fasteners. A perimeter sealing member, preferably made from a suitable rubber material is fitted into a groove around the bottom edge of terminal housing 84 and serves as the means by which fluid leakage from inner cavity 50 is prevented from occurring at the joining area between terminal assembly 40 and solenoid assembly 43. Male electrical connector 66 protrudes through a hole in perimeter sealing member 48, which serves as a means by which fuel is prevented from making contact with the electrical components. Those skilled in the art will appreciate that terminal assembly 40 actually includes two terminals 62 as shown in FIG. 2, but only one of which is capable of being seen in the section view of FIG. 5.

Figure 6:
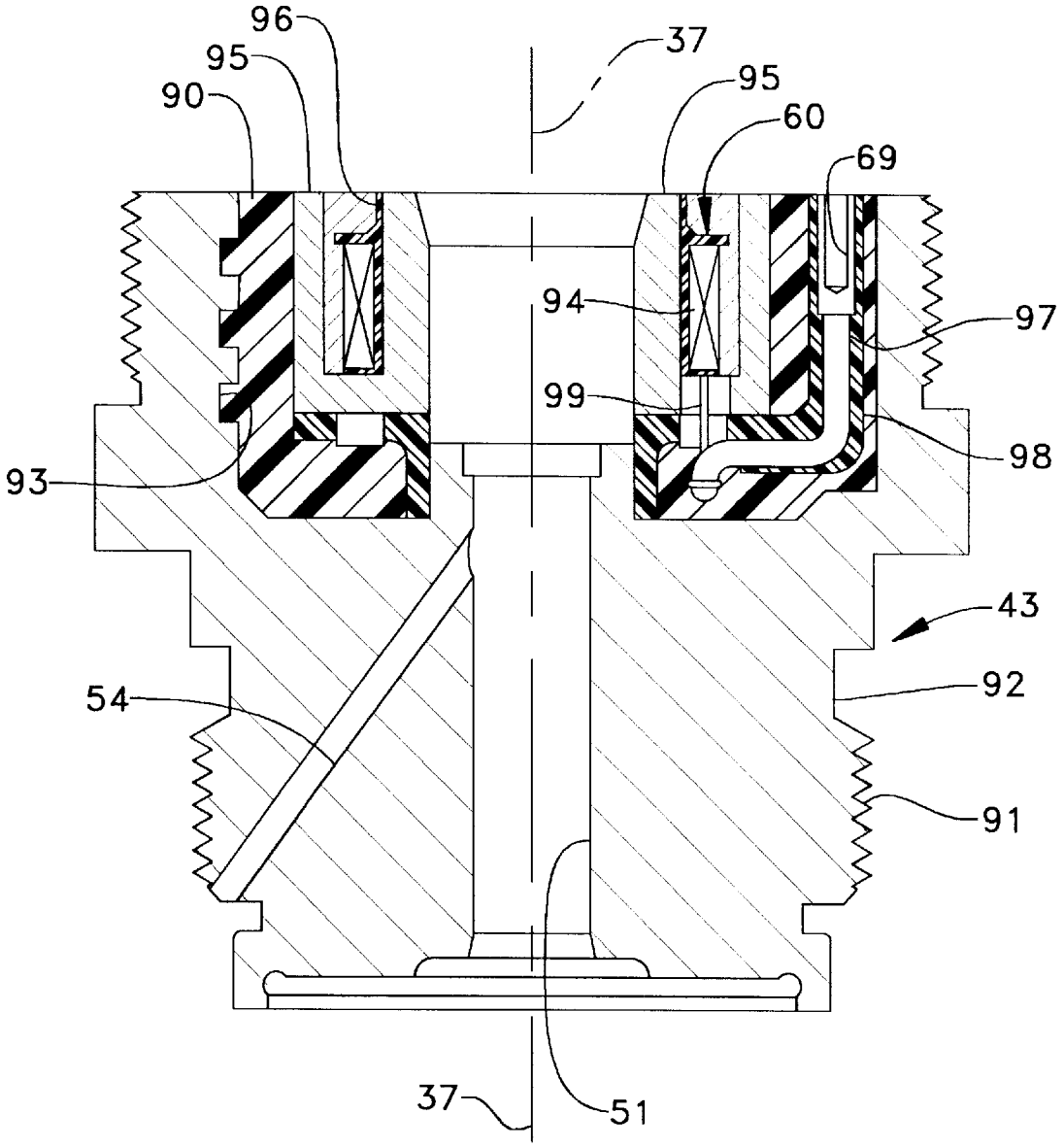
FIG. 6 is a sectioned side elevational view of a solenoid assembly according to another aspect of the present invention.

Referring now to FIG. 6, solenoid assembly 43 includes solenoid 60, a solenoid housing 92 having external threads 91 on its outer surface and defining on its interior a guide bore 51, a metering passage 54 and a solenoid cavity 93. Solenoid housing 92, like terminal housing 84, is preferably made from a suitable metallic alloy. A solenoid coil 94 includes a wire winding contained upon a bobbin 96 with a free end of the wire attached to one end of a conductor 97. The opposite end of conductor 97 includes a female electrical connector 69 that receives male electrical connector 66 as shown in FIG. 3. Bobbin 96 is received within a magnetic flux carrier 95 which is made from a suitable ferromagnetic alloy. During manufacture, solenoid coil 94, magnetic flux carrier 95 and conductor 97, which is preferably made of brass, are mounted on a receptacle carrier 98 that is made from a suitable non-electrically conducting plastic material. This assembly is then positioned within solenoid cavity 93 and surrounded by plastic solenoid carrier 90, which is an epoxy overmold, to fix the same in place within solenoid cavity 93 and also to magnetically and electrically isolate solenoid 60 from the metal of solenoid housing 92. This assembly could also be molded outside of solenoid housing 92 and then attached through a threaded engagement or by suitable fasteners.

Industrial Applicability

The present invention finds potential application in any solenoid actuated control valve. The magnetic isolation concepts of the present invention are particularly applicable to control valves in which a solenoid must be embedded within the body of the valve such that the armature is positioned between a portion of a terminal assembly and a solenoid coil as seen in FIG. 3. In such cases, there are space constraints that restrict the size of the solenoid that can be utilized; however, by isolating the solenoid from the outer metallic housing with an epoxy plastic, or other suitable material, the solenoid can generate a force quicker and less magnetic leakage occurs. This results in a faster response time for the valve. This magnetic isolation is further provided by utilizing a non-magnetic armature stop 63 and other non-magnetic features such as spacer 73, 71 or fastener 67 to complete the isolation of the electromagnetic components from the ferromagnetic housing portions of terminal assembly 40, solenoid assembly 43 and valve member 65.

By modularizing the construction of the control valve of the present invention, assembly of the valve in a production environment is greatly simplified. Both the terminal assembly and the solenoid assembly behave as single integral components at the time of assembly. The structure of the present invention also decreases the number of electrical connections between the exposed terminals 62 and the wire winding of the solenoid to only two electrical connections. One connection being where the wire winding is attached to conductor 98, preferably with a solder joint, and the other electrical connection being where male electrical connector 66 mates to female electrical connector 69. This decrease in the number of electrical connections improves robustness, reliability and the working life of the control valve.

While the present invention finds potential application in a wide variety of fluid valves, it finds particular application in control valves for fuel injectors. More particularly, the present invention finds a preferred application in cartridge control valves of the type utilized with cam actuated electronically controlled fuel injectors of the type manufactured by Caterpillar, Inc. of Peoria, Ill. In this latter application, the magnetic isolation features of the present invention can improve valve response time by as much as 25% or more over prior art cartridge control valves occupying the same space envelope.

Those skilled in the art will appreciate that numerous modifications and alternative embodiments of the present invention will be apparent in view of the foregoing description. For instance, valve members having one or more conical valve surfaces, as well as spool valve members, are contemplated for use with the present invention. Furthermore, valves in other types of injectors, such as hydraulically actuated fuel injectors, could potentially benefit from the present invention. Accordingly, this description is to be construed as illustrative only and is for the purpose of teaching those skilled in the art the best mode of carrying out the invention. The details of the structure may be varied substantially without departing from the spirit of the invention, the scope of which is defined in terms of the claims as set forth below.

We claim:

1. A control valve comprising:

a terminal assembly including a terminal electrically connected to one of a male electrical connector and female electrical connector;

a solenoid assembly including a metallic solenoid housing defining a solenoid cavity, a solenoid coil and the other of said male electrical connector and said female electrical connector molded into a plastic solenoid carrier, and said plastic solenoid carrier being attached to said metallic solenoid housing and positioned in said solenoid cavity;

said solenoid assembly being attached to said terminal assembly, and said male electrical connector being mated to said female electrical connector;

an armature positioned between a portion of said terminal assembly and said solenoid coil; and a valve member attached to said armature.

2. The control valve of claim 1 wherein said terminal assembly includes a metallic terminal housing defining a terminal cavity;

a plastic terminal carrier molded around a portion of said terminal and said one of a male electrical connector and a female electrical connector; and said plastic terminal carrier being positioned in said terminal cavity and attached to said metallic terminal housing.

3. The control valve of claim 2 further comprising an armature stop made from a non-magnetic material attached to said armature and positioned to magnetically isolate said armature from said metallic terminal housing.

4. The control valve of claim 2 wherein said plastic solenoid carrier is made from an epoxy material that is substantially impervious to fuel fluid.

5. The control valve of claim 1 wherein said terminal assembly is attached to said solenoid assembly with a hollow cap that receives said terminal assembly and threads onto an outer surface of said solenoid assembly.

6. The control valve of claim 1 wherein said solenoid coil includes a winding at least partially surrounded by a magnetic flux carrier; and said solenoid coil being magnetically isolated from said metallic solenoid housing by said plastic solenoid carrier.

7. The control valve of claim 1 further comprising a perimeter sealing member positioned between said solenoid assembly and said terminal assembly and surrounding a portion of said one of a male electrical connector and a female electrical connector.

8. The control valve of claim 1 further comprising a valve body portion defining an inlet passage separated from an outlet passage by a flat valve seat; and said valve member includes an annular knife edge valve surface that closes said inlet passage to said outlet passage when seated against said flat valve seat.

9. The control valve of claim 8 further comprising a compression spring operably positioned to bias said valve member toward an open position in which said annular knife edge valve surface is away from said flat valve seat.

10. The control valve of claim 1 wherein said armature is attached to, but magnetically isolated from, said valve member by at least one of a non-magnetic spacer and a non-magnetic fastener.

11. A control valve comprising:

a terminal assembly including a metallic terminal housing defining a terminal cavity, a plastic terminal carrier molded around a portion of a terminal and one of a male electrical connector and a female electrical connector, and said plastic terminal carrier being positioned in said terminal cavity and attached to said metallic terminal housing;

a solenoid assembly including a metallic solenoid housing defining a solenoid cavity, a solenoid coil and the other of said male electrical connector and said female electrical connector molded into a plastic solenoid carrier, and said plastic solenoid carrier being attached to said metallic solenoid housing and positioned in said solenoid cavity;

said solenoid assembly being attached to said terminal assembly, and said male electrical connector being mated to said female electrical connector;

an armature positioned between a portion of said terminal assembly and said solenoid coil, and said armature being magnetically isolated from said metallic terminal housing and said metallic solenoid housing by space; and a valve member attached to said armature.

12. The control valve of claim 11 wherein said solenoid coil includes a winding at least partially surrounded by a magnetic flux carrier; and said solenoid coil being magnetically isolated from said metallic solenoid housing by said plastic solenoid carrier.

13. The control valve of claim 12 further comprising a perimeter sealing member positioned between said solenoid assembly and said terminal assembly and surrounding a portion of said one of a male electrical connector and a female electrical connector.

14. The control valve of claim 13 wherein said armature is attached to, but magnetically isolated from, said valve member by at least one of a non-magnetic spacer and a non-magnetic fastener.

15. The control valve of claim 14 further comprising a valve body portion defining an inlet passage separated from an outlet passage by a flat valve seat; and said valve member includes an annular knife edge valve surface that closes said inlet passage to said outlet passage when seated against said flat valve seat.

16. A fuel injector comprising:

an injector body defining a fuel inlet, a nozzle outlet and a cartridge opening, and further defining a spill passage and a return passage that open into said cartridge opening;

a cartridge control valve received in said cartridge opening and attached to said injector body;

said cartridge control valve including a terminal assembly attached to a solenoid assembly;

said cartridge control valve defining a portion of an outlet passage that opens to said return passage;

said cartridge control valve defining a portion of an inlet passage that opens to said spill passage;

a valve member positioned to reciprocate in said cartridge control valve between an open position in which said inlet passage is open to said outlet passage and a closed position in which said outlet passage is closed to said inlet passage;

said terminal assembly including a terminal electrically connected to one of a male electrical connector and female electrical connector; and said solenoid assembly including a metallic solenoid housing defining a solenoid cavity, a solenoid coil and the other of said male electrical connector and said female electrical connector molded into a plastic solenoid carrier, and said plastic solenoid carrier being attached to said metallic solenoid housing and positioned in said solenoid cavity.

17. The fuel injector of claim 16 wherein said terminal assembly includes a metallic terminal housing defining a terminal cavity;

a plastic terminal carrier molded around a portion of said terminal and said one of a male electrical connector and a female electrical connector; and said plastic terminal carrier being positioned in said terminal cavity and attached to said metallic terminal housing;

said solenoid coil includes a winding at least partially surrounded by a magnetic flux carrier; and said solenoid coil being magnetically isolated from said metallic solenoid housing by said plastic solenoid carrier.

18. The fuel injector of claim 16 wherein said armature is attached to, but magnetically isolated from, said valve member by at least one of a non-magnetic spacer and a non-magnetic fastener.

19. The fuel injector of claim 16 wherein said inlet passage separated from said outlet passage by a flat valve seat; and said valve member includes an annular knife edge valve surface that closes said inlet passage to said outlet passage when seated against said flat valve seat.

20. The fuel injector of claim 16 further comprising a perimeter sealing member positioned between said solenoid assembly and said terminal assembly and surrounding a portion of said one of a male electrical connector and a female electrical connector.

* * * * *